US008729394B2

(12) United States Patent
Clark et al.

(10) Patent No.: US 8,729,394 B2
(45) **Date of Patent: *May 20, 2014**

(54) ENHANCED DATA CABLE WITH CROSS-TWIST CABLED CORE PROFILE

(75) Inventors: William T. Clark, Lancaster, MA (US); Peter D. MacDonald, Gardner, MA (US); Joseph Dellagala, Shrewsbury, MA (US)

(73) Assignee: Belden Inc., St. Louis, MO (US)

( * ) Notice: Subject to any disclaimer, the term of this patent is extended or adjusted under 35 U.S.C. 154(b) by 102 days.

This patent is subject to a terminal disclaimer.

(21) Appl. No.: 10/430,365

(22) Filed: May 5, 2003

(65) Prior Publication Data

US 2011/0155419 A1 Jun. 30, 2011

Related U.S. Application Data

(63) Continuation of application No. 09/532,837, filed on Mar. 21, 2000, now Pat. No. 6,596,944, which is a continuation of application No. 08/841,440, filed on Apr. 22, 1997, now Pat. No. 6,074,503.

(51) Int. Cl.
*H01B 11/02* (2006.01)

(52) U.S. Cl.
USPC ..... 174/113 R; 174/113 C

(58) Field of Classification Search
USPC ..... 174/113 C, 113 R
See application file for complete search history.

(56) References Cited

U.S. PATENT DOCUMENTS

| | | | | |
|---|---|---|---|---|
| 483,285 | A | | 9/1892 | Guilleaume |
| 514,925 | A | | 2/1894 | Guilleaume |
| 524,452 | A | | 8/1894 | Ebel et al. |
| 867,659 | A | | 10/1907 | Hoopes et al. |
| 1,008,370 | A | | 11/1911 | Robillot |
| 1,132,452 | A | | 3/1915 | Davis |
| 1,389,143 | A | * | 8/1921 | Kempton ..... 138/141 |
| 1,700,606 | A | | 1/1929 | Beaver |
| 1,940,917 | A | | 12/1933 | Okazaki |
| 1,977,209 | A | | 10/1934 | Sargent |
| 1,995,201 | A | | 3/1935 | Delon |
| 2,041,842 | A | | 5/1936 | Layton |
| 2,149,772 | A | | 3/1939 | Hunter et al. |
| 2,204,737 | A | | 6/1940 | Swallow et al. |

(Continued)

FOREIGN PATENT DOCUMENTS

| | | |
|---|---|---|
| CA | 1164064 | 3/1984 |
| CA | 2058046 | 8/1992 |

(Continued)

OTHER PUBLICATIONS

Bell Communications Research, "Generic Requirements for Optical Fiber and Optical Fiber Cable", Aug. 5, 1986.

(Continued)

*Primary Examiner* — Chau Nguyen

(74) *Attorney, Agent, or Firm* — Foley & Lardner LLP

(57) ABSTRACT

A cable exhibiting reduced crosstalk between transmission media includes a core having a profile with a shape which defines spaces or channels to maintain a spacing between transmission media in a finished cable. The core is formed of a conductive material to further reduce crosstalk. A method of producing a cable introduces a core as described above into the cable assembly and imparts a cable closing twist to the assembly.

28 Claims, 3 Drawing Sheets

(56) References Cited

U.S. PATENT DOCUMENTS 2,218,830 A 10/1940 Rose et al.
2,344,501 A 3/1944 Bennett
2,538,019 A 1/1947 Lee
2,501,457 A 3/1950 Thelin
2,583,025 A 1/1952 Swift et al.
2,583,026 A 1/1952 Swift et al.
2,792,442 A 5/1957 Parce
2,804,494 A 8/1957 Fenton
2,882,676 A 4/1959 Bryan et al.
3,032,604 A 5/1962 Timmons
3,055,967 A 9/1962 Bondon
3,209,064 A 9/1965 Cutler
3,259,687 A 7/1966 Oatess et al.
3,328,510 A 6/1967 White
3,340,112 A 9/1967 Davis et al.
3,350,647 A 10/1967 Gabriel et al.
3,363,047 A 1/1968 Grove
3,364,305 A 1/1968 Hanlon et al.
3,489,844 A 1/1970 Motley
3,559,390 A 2/1971 Staschewski et al.
3,588,313 A 6/1971 Delves-Broughton
3,603,715 A 9/1971 Eilhardt et al.
3,610,814 A 10/1971 Peacock
3,621,118 A 11/1971 Bunish et al.
3,644,659 A 2/1972 Campbell
3,649,744 A 3/1972 Coleman
3,715,877 A 2/1973 Akachi
3,775,548 A * 11/1973 Zinser et al. ..... 174/23 C
3,819,443 A 6/1974 Simons et al.
3,823,255 A 7/1974 La Gase et al.
3,881,052 A 4/1975 Britz et al.
3,888,710 A 6/1975 Burk
3,911,200 A * 10/1975 Simons et al. ..... 174/36
3,921,378 A 11/1975 Spicer et al.
3,927,247 A 12/1975 Timmons
3,945,974 A 3/1976 Schwarcz et al.
3,999,003 A 12/1976 Chevrolet et al.
4,034,148 A 7/1977 Lang
4,038,489 A 7/1977 Stenson et al.
4,205,899 A 6/1980 King et al.
4,257,675 A 3/1981 Nakagome et al.
4,319,940 A 3/1982 Arroyo et al.
4,327,246 A 4/1982 Kincaid
4,361,381 A 11/1982 Williams
4,374,888 A 2/1983 Bornslaeger
4,385,485 A 5/1983 Yonechi
4,393,582 A 7/1983 Arnold, Jr. et al.
4,401,366 A 8/1983 Hope
4,401,845 A 8/1983 Odhner et al.
4,406,914 A 9/1983 Kincaid
4,412,094 A 10/1983 Dougherty et al.
4,428,787 A 1/1984 Pan et al.
4,446,689 A 5/1984 Hardin et al.
4,447,122 A 5/1984 Sutehall
4,453,031 A * 6/1984 Justiss ..... 174/36
4,456,331 A 6/1984 Whitehead et al.
4,474,426 A 10/1984 Yataki
4,487,992 A 12/1984 Tomita
4,500,748 A 2/1985 Klein
4,510,346 A 4/1985 Bursh, Jr. et al.
4,510,348 A 4/1985 Arroyo et al.
4,549,041 A 10/1985 Shingo et al.
4,568,401 A 2/1986 Davis
4,595,793 A 6/1986 Arroyo et al.
4,600,268 A 7/1986 Spicer
RE32,225 E 8/1986 Neuroth
4,605,818 A 8/1986 Arroyo et al.
4,644,098 A 2/1987 Norris et al.
4,645,628 A 2/1987 Gill
4,654,476 A 3/1987 Barnicol-Ottler et al.
4,661,406 A 4/1987 Gruhn et al.
4,683,349 A 7/1987 Takebe
4,697,051 A 9/1987 Beggs et al.
4,710,594 A 12/1987 Walling et al.
4,712,368 A 12/1987 Garner
4,719,319 A 1/1988 Tighe, Jr.
4,729,409 A 3/1988 Paul
4,755,629 A 7/1988 Beggs et al.
4,767,891 A 8/1988 Biegon et al.
4,777,325 A 10/1988 Siwinski
4,778,246 A 10/1988 Carroll
4,784,461 A 11/1988 Abe et al.
4,784,462 A 11/1988 Priaroggia
4,788,088 A 11/1988 Kohl
4,800,236 A 1/1989 Lemke
4,804,702 A 2/1989 Bartoszek
4,807,962 A 2/1989 Arroyo et al.
4,828,352 A 5/1989 Kraft
4,873,393 A 10/1989 Friesen et al.
4,892,442 A 1/1990 Shoffner
4,912,283 A 3/1990 O'Connor
4,935,467 A 6/1990 Cheng
4,941,729 A 7/1990 Hardin et al.
4,963,609 A 10/1990 Anderson et al.
4,987,394 A 1/1991 Harman et al.
5,000,539 A 3/1991 Gareis
5,010,210 A 4/1991 Sidi
5,015,800 A 5/1991 Vaupotic et al.
5,037,999 A 8/1991 VanDeusen
5,043,530 A 8/1991 Davies
5,068,497 A 11/1991 Krieger
5,073,682 A 12/1991 Walling et al.
5,077,449 A 12/1991 Cornibert et al.
5,087,110 A 2/1992 Inagaki et al.
5,097,099 A 3/1992 Miller
5,107,076 A 4/1992 Bullock et al.
5,132,488 A 7/1992 Tessier et al.
5,132,490 A 7/1992 Aldissi
5,132,491 A 7/1992 Mulrooney et al.
5,132,788 A 7/1992 Hirota
5,142,100 A 8/1992 Faupotic
5,149,915 A 9/1992 Brunker et al.
5,155,304 A 10/1992 Gossett et al.
5,155,789 A 10/1992 Le Noane et al.
5,162,609 A 11/1992 Adriaenssens et al.
5,170,010 A 12/1992 Aldissi
5,177,809 A 1/1993 Zeidler
5,180,884 A 1/1993 Aldissi
5,180,890 A 1/1993 Pendergrass
5,202,946 A 4/1993 Hardin et al.
5,212,350 A 5/1993 Gebs
5,216,202 A 6/1993 Yoshida et al.
5,220,130 A 6/1993 Walters
5,222,177 A 6/1993 Chau et al.
5,227,417 A 7/1993 Kroushl
5,238,328 A 8/1993 Adams et al.
5,245,134 A 9/1993 Vana, Jr. et al.
5,283,390 A 2/1994 Hubis
5,289,556 A 2/1994 Rawlyk et al.
5,298,680 A 3/1994 Kenny
5,304,739 A 4/1994 Klug et al.
5,305,797 A 4/1994 Roy, Sr.
5,313,020 A 5/1994 Sackett
5,329,064 A 7/1994 Tash et al.
5,355,427 A 10/1994 Gareis et al.
5,399,813 A 3/1995 McNeill
5,418,878 A 5/1995 Sass et al.
5,424,491 A 6/1995 Walling et al.
5,434,354 A 7/1995 Baker et al.
5,444,184 A 8/1995 Hassel
5,486,649 A 1/1996 Gareis
5,493,071 A 2/1996 Newmoyer
5,514,837 A * 5/1996 Kenny et al. ..... 174/113 R
5,541,361 A 7/1996 Friesen et al.
5,544,270 A 8/1996 Clark et al.
5,557,698 A 9/1996 Gareis et al.
5,563,377 A 10/1996 Arpin et al.
5,574,250 A 11/1996 Hardie et al.
5,576,515 A 11/1996 Bleich et al.
5,600,097 A 2/1997 Bleich et al.
5,606,151 A 2/1997 Siekierka et al.
5,619,016 A 4/1997 Newmoyer
5,658,406 A 8/1997 Walling et al.
5,659,152 A 8/1997 Horie et al.

(56) References Cited

U.S. PATENT DOCUMENTS

| | | | | |
|---|---|---|---|---|
| 5,666,452 | A | 9/1997 | Deitz, Sr. et al. | |
| 5,670,748 | A | 9/1997 | Gingue | |
| 5,696,295 | A | 12/1997 | Wulff et al. | |
| 5,698,323 | A | 12/1997 | Keough et al. | |
| 5,699,467 | A | 12/1997 | Kojima et al. | |
| 5,763,823 | A | 6/1998 | Siekierka et al. | |
| 5,767,411 | A | 6/1998 | Maron | |
| 5,789,711 | A | 8/1998 | Gaeris et al. | |
| 5,796,046 | A | 8/1998 | Newmoyer et al. | |
| 5,821,466 | A | 10/1998 | Clark et al. | |
| 5,821,467 | A | 10/1998 | O'Brien et al. | |
| 5,834,697 | A | 11/1998 | Baker et al. | |
| 5,841,072 | A | 11/1998 | Gagnon et al. | |
| 5,883,334 | A | 3/1999 | Newmoyer et al. | |
| 5,900,588 | A | 5/1999 | Springer et al. | |
| 5,920,672 | A | 7/1999 | White | |
| 5,936,205 | A | 8/1999 | Newmoyer et al. | |
| 5,952,607 | A | 9/1999 | Friesen et al. | |
| 5,952,615 | A * | 9/1999 | Prudhon | 174/113 C |
| 5,956,445 | A | 9/1999 | Deitz, Sr. et al. | |
| 5,969,295 | A | 10/1999 | Boucino et al. | |
| 5,990,419 | A | 11/1999 | Bogese, II | |
| 6,037,546 | A | 3/2000 | Mottine et al. | |
| 6,074,503 | A | 6/2000 | Clark et al. | |
| 6,091,025 | A | 7/2000 | Cotter et al. | |
| 6,099,345 | A | 8/2000 | Milner et al. | |
| 6,140,587 | A | 10/2000 | Sackett | |
| 6,150,612 | A | 11/2000 | Grandy et al. | |
| 6,153,826 | A | 11/2000 | Kenny et al. | |
| 6,162,992 | A | 12/2000 | Clark et al. | |
| 6,169,251 | B1 | 1/2001 | Grant et al. | |
| 6,194,663 | B1 | 2/2001 | Friesen et al. | |
| 6,211,467 | B1 | 4/2001 | Berelsman et al. | |
| 6,222,129 | B1 | 4/2001 | Siekierka et al. | |
| 6,222,130 | B1 | 4/2001 | Gareis et al. | |
| 6,248,954 | B1 | 6/2001 | Clark et al. | |
| 6,255,593 | B1 | 7/2001 | Reede | |
| 6,272,858 | B1 | 8/2001 | Takano et al. | |
| 6,288,340 | B1 | 9/2001 | Arnould | |
| 6,297,454 | B1 | 10/2001 | Gareis | |
| 6,300,573 | B1 | 10/2001 | Horie et al. | |
| 6,303,867 | B1 | 10/2001 | Clark et al. | |
| 6,310,295 | B1 | 10/2001 | Despard | |
| 6,318,062 | B1 | 11/2001 | Doherty | |
| 6,355,876 | B1 | 3/2002 | Morimoto | |
| 6,365,836 | B1 | 4/2002 | Blouin et al. | |
| 6,378,283 | B1 | 4/2002 | Barton | |
| 6,392,152 | B1 | 5/2002 | Mottine, Jr. et al. | |
| 6,403,887 | B1 | 6/2002 | Kebabjian et al. | |
| 6,441,308 | B1 | 8/2002 | Gagnon | |
| 6,452,094 | B2 | 9/2002 | Donner et al. | |
| 6,462,268 | B1 | 10/2002 | Hazy et al. | |
| 6,506,976 | B1 | 1/2003 | Neveux, Jr. | |
| 6,566,607 | B1 | 5/2003 | Walling | |
| 6,570,095 | B2 | 5/2003 | Clark et al. | |
| 6,596,944 | B1 | 7/2003 | Clark et al. | |
| 6,624,359 | B2 | 9/2003 | Bahlmann et al. | |
| 6,639,152 | B2 | 10/2003 | Glew et al. | |
| 6,686,537 | B1 | 2/2004 | Gareis et al. | |
| 6,687,437 | B1 | 2/2004 | Starnes et al. | |
| 6,770,819 | B2 | 8/2004 | Patel | |
| 6,787,697 | B2 | 9/2004 | Stipes et al. | |
| 6,800,811 | B1 | 10/2004 | Boucino | |
| 6,812,408 | B2 | 11/2004 | Clark et al. | |
| 6,815,611 | B1 | 11/2004 | Gareis | |
| 6,818,832 | B2 | 11/2004 | Hopkinson et al. | |
| 6,855,889 | B2 | 2/2005 | Gareis | |
| 6,858,804 | B2 | 2/2005 | Murakami et al. | |
| 6,888,070 | B1 | 5/2005 | Prescott | |
| 6,897,382 | B2 | 5/2005 | Hager et al. | |
| 6,974,913 | B2 | 12/2005 | Bahlmann et al. | |
| 6,998,537 | B2 | 2/2006 | Clark et al. | |
| 7,015,397 | B2 | 3/2006 | Clark | |
| 7,030,321 | B2 | 4/2006 | Clark | |
| 7,049,523 | B2 | 5/2006 | Shuman et al. | |
| 7,053,310 | B2 | 5/2006 | Clark | |
| 7,064,277 | B1 | 6/2006 | Lique et al. | |
| 7,098,405 | B2 | 8/2006 | Glew | |
| 7,109,424 | B2 | 9/2006 | Nordin et al. | |
| 7,115,815 | B2 | 10/2006 | Kenny et al. | |
| 7,135,641 | B2 | 11/2006 | Clark | |
| 7,145,080 | B1 | 12/2006 | Boisvert et al. | |
| 7,154,043 | B2 | 12/2006 | Clark | |
| 7,157,644 | B2 | 1/2007 | Lique et al. | |
| 7,173,189 | B1 | 2/2007 | Hazy et al. | |
| 7,179,999 | B2 | 2/2007 | Clark | |
| 7,196,271 | B2 | 3/2007 | Cornibert et al. | |
| 7,208,683 | B2 | 4/2007 | Clark | |
| 7,214,880 | B2 | 5/2007 | Wiekhorst et al. | |
| 7,214,884 | B2 | 5/2007 | Kenny et al. | |
| 7,220,918 | B2 | 5/2007 | Kenny et al. | |
| 7,238,885 | B2 | 7/2007 | Lique et al. | |
| 7,238,886 | B2 | 7/2007 | Wiekhorst et al. | |
| 7,244,893 | B2 | 7/2007 | Clark | |
| 7,256,351 | B2 | 8/2007 | Dillon et al. | |
| 7,262,366 | B2 | 8/2007 | Clark | |
| 7,271,342 | B2 | 9/2007 | Stutzman et al. | |
| 7,271,343 | B2 | 9/2007 | Clark | |
| 7,276,664 | B2 | 10/2007 | Gagnon | |
| 7,289,332 | B2 | 10/2007 | Clark | |
| 7,317,163 | B2 | 1/2008 | Lique et al. | |
| 7,329,815 | B2 | 2/2008 | Kenny et al. | |
| 7,339,116 | B2 | 3/2008 | Gareis et al. | |
| 7,358,436 | B2 | 4/2008 | Dellagala et al. | |
| 7,390,971 | B2 | 6/2008 | Jean et al. | |
| 7,405,360 | B2 | 7/2008 | Clark et al. | |
| 7,449,638 | B2 | 11/2008 | Clark et al. | |
| 7,462,782 | B2 | 12/2008 | Clark | |
| 7,491,888 | B2 | 2/2009 | Clark | |
| 7,507,910 | B2 | 3/2009 | Park et al. | |
| 7,534,964 | B2 | 5/2009 | Clark et al. | |
| 7,622,680 | B2 | 11/2009 | Bricker et al. | |
| 7,663,061 | B2 | 2/2010 | Gareis et al. | |
| 7,977,575 | B2 | 7/2011 | Gareis et al. | |
| 2001/0013418 | A1 | 8/2001 | Donner et al. | |
| 2002/0050394 | A1 | 5/2002 | Clark et al. | |
| 2003/0106704 | A1 | 6/2003 | Isley et al. | |
| 2003/0230427 | A1 | 12/2003 | Gareis | |
| 2004/0050578 | A1 | 3/2004 | Hudson | |
| 2004/0055777 | A1 | 3/2004 | Wiekhorst et al. | |
| 2004/0055779 | A1 | 3/2004 | Wiekhorst et al. | |
| 2004/0055781 | A1 | 3/2004 | Cornibert et al. | |
| 2004/0118593 | A1 | 6/2004 | Augustine et al. | |
| 2004/0216913 | A1 | 11/2004 | Wiekhorst et al. | |
| 2004/0256139 | A1 | 12/2004 | Clark | |
| 2005/0006132 | A1 | 1/2005 | Clark | |
| 2005/0051355 | A1 | 3/2005 | Bricker et al. | |
| 2005/0092515 | A1 | 5/2005 | Kenny et al. | |
| 2005/0133246 | A1 | 6/2005 | Parke et al. | |
| 2006/0032660 | A1 | 2/2006 | Parke et al. | |
| 2006/0131054 | A1 | 6/2006 | Lique et al. | |
| 2006/0131055 | A1 | 6/2006 | Lique et al. | |
| 2006/0131057 | A1 | 6/2006 | Lique et al. | |
| 2006/0131058 | A1 | 6/2006 | Lique et al. | |
| 2006/0243477 | A1 | 11/2006 | Jean et al. | |
| 2007/0044994 | A1 | 3/2007 | Park et al. | |
| 2007/0044996 | A1 | 3/2007 | Clark | |
| 2007/0209823 | A1 | 9/2007 | Vexler et al. | |
| 2008/0041609 | A1 | 2/2008 | Gareis et al. | |
| 2008/0164049 | A1 | 7/2008 | Vexler et al. | |
| 2009/0133895 | A1 | 5/2009 | Allen | |
| 2009/0173514 | A1 | 7/2009 | Gareis | |

FOREIGN PATENT DOCUMENTS

| | | |
|---|---|---|
| CA | 2071417 | 12/1993 |
| DE | 697378 | 10/1940 |
| DE | 2459844 | 7/1976 |
| DE | 9011484 | 11/1990 |
| DE | 4336230 | 3/1995 |
| EP | 0961296 | 12/1999 |
| EP | 1087410 | 3/2000 |
| EP | 1059343 | 12/2000 |
| EP | 1085530 | 3/2001 |

(56) References Cited

FOREIGN PATENT DOCUMENTS

| | | |
|---|---|---|
| EP | 1107262 | 6/2001 |
| EP | 1117103 | 7/2001 |
| EP | 1130604 | 9/2001 |
| EP | 1162632 | 12/2001 |
| EP | 1215688 | 6/2002 |
| EP | 1548754 | 6/2005 |
| FR | 694100 | 11/1930 |
| FR | 1265877 | 5/1961 |
| FR | 2706068 | 12/1994 |
| GB | 342606 | 2/1931 |
| GB | 725624 | 3/1955 |
| GB | 2260216 | 4/1993 |
| JP | 1942-10582 | 9/1942 |
| JP | S29-15973 | 12/1955 |
| JP | 43-1986-15470 | 6/1968 |
| JP | S5197633331 | 8/1976 |
| JP | 52-1977-76694 | 6/1977 |
| JP | 5619817307 | 1/1981 |
| JP | 5619818011 | 1/1981 |
| JP | 61-1986-13507 | 1/1986 |
| JP | 4332406 | 11/1992 |
| JP | 5-101711 | 4/1993 |
| JP | 8-1996-96635 | 4/1996 |
| JP | 11-053958 | 2/1999 |
| SU | 1343447 | 10/1987 |
| WO | WO 96/24143 | 8/1996 |
| WO | WO 98/48430 | 10/1998 |
| WO | WO 00/51142 | 8/2000 |
| WO | WO 00/79545 | 12/2000 |
| WO | WO 01/08167 | 2/2001 |
| WO | WO 01/29828 | 4/2001 |
| WO | WO 01/29848 | 4/2001 |
| WO | WO01/54142 | 7/2001 |
| WO | WO01/93281 | 12/2001 |
| WO | WO03/077265 | 9/2003 |
| WO | WO03/094178 | 11/2003 |
| WO | WO2005/041219 | 5/2005 |
| WO | WO2005/048274 | 5/2005 |

OTHER PUBLICATIONS

Hitachi Cable Manchester, Customer Specification.

Refi, "Fiber Optic Cable: A Lightguide," 1991.

Hawley, "Condensed Chemical Dictionary" 1981, pp. 471, 840, 841.

Images of Belden 1711A Datatwist 300 4PR23 shielded cable, Sep. 11, 1995.

Comprehensive Dictionary of Electrical Engineering 188 2nd ed., Phillip A. Laplante, Editor in Chief, 2005, 3 pages.

Diminico, Chris, "Lower cost copper solutions may drive 1-Gigabit Ethernet", Aug. 1, 2003, http://www.cablinginstall.com/articles/print/volume-11/issue-8/contents/installation/lower-cost-copper-solutions-may-drive-10-gigabit-ethernet.html, 6 pages.

Electronics Engineers' Handbook 1.3.1., Donald Christiansen, Editor in Chief, Fourth Edition, 1997, 1 page.

Hayes, Trent M., presentation entitled, "Evaluation of Alien Crosstalk in Cat 5e and Cat 6 Installations", IEEE 802.3 10GBASE-T Study Group, Mar. 2003, 26 pages.

Hitachi Cable Manchester, Inc., Product Specification Sheet, for "Category 5 Hi-NET Supra, Consisting of 4 Pairs, 24 AWG, Unshielded with an Overall Jacket, CMP, MPP, C(UL), Type FT6", web-page publication, Apr. 23, 1977, pp. 1-7.

International Search Report from International Application No. PCT/US2006/047113, Apr. 3, 2007, 2 pages.

File History of U.S. Patent No. 5,424,491, filed Oct. 8, 1993, Date of Patent: Jun. 13, 1995.

File History of U.S. Patent No. 6,570,095, filed May 11, 2011, Date of Patent: May 27, 2003.

File History of U.S. Patent No. 6,074,703, filed Apr. 22, 1999, Date of Patent: Jun. 13, 2000.

File History of U.S. Patent No. 6,998,537, filed Jan. 3, 2003, Date of Patent: Feb. 14, 2006.

File History of U.S. Patent No. 6,596,944, filed Mar. 21, 2000, Date of Patent: Jul. 22, 2003.

File History of U.S. Patent No. 7,339,116, filed Jan. 18, 2001, Date of Patent: Mar. 4, 2008.

File History of U.S. Patent No. 7,199,999, filed Oct. 11, 2005, Date of Patent: Apr. 3, 2007.

Merriam-Webster Online Dictionary, Nov. 28, 2009, 1 page.

Declaration of Anne Shea Gaza, Redacted Public Version from Delaware District Court C.A. No. 08-063-SLR, Jan. 20, 2010, pp. 1-55.

Responsive Claims Construction Brief of Plaintiffs Belden Technologies, Inc. and Belden CDT (Canada) Inc., Redacted Public Version, from Delaware District Court C.A. No. 08-063-SLR, Jan. 20, 2010, pp. 1-49.

Superior Essex Inc.'s and Superior Essex Communications LP's Answering Brief in Opposition to Belden's Motion from Summary Judgment of No. Patent Invalidity by Anticipation, Redacted Public Version, from Delaware District Court C.A. No. 08-063-Slr, Feb. 3, 2010, pp. 1-51.

Answer to Answer to Amended Complaint, Counterclaim Plaintiffs Belden Technologies, Inc. and Belden CDT (Canada) Inc.'s Answer to Defendants Superior Essex Inc. and Superior Essex Communications LP's Counterclaims; by Belden Technologies, Inc., Belden CDT (Canada) Inc. (Poff, Adam) (Entered: May 11, 2009).

Plaintiffs Belden Technologies, Inc. and Belden CDT (Canada), Inc.'s Reply Brief in Support of Their Motion for Partial Summary Judgment No. 1: Patent Infringement, Redacted Public Version, from Delaware District Court C.A. No. 08-063-SLR, Feb. 17, 2010, pp. 1-22.

Superior Essex Inc.'s and Superior Essex Communications LP's Reply Brief in Support of Their Motion for Partial Summary Judgment of Non-Infringement, Redacted Public Version, from Delaware District Court C.A. No. 08-063-SLR, Feb. 17, 2010, pp. 1-24.

Superior Essex Inc.'s and Superior Essex Communications LP's Reply Brief in Support of Their Motion for Summary Judgment of Invalidity of the Patents-In-Suit, Redacted Public Version, from Delaware District Court C.A. No. 08-063-SLR, Feb. 17, 2010, pp. 1-25.

Declaration of Anne Shea Gaza, Redacted Public Version, from Delaware District Court C.A. No. 08-063-SLR, Feb. 17, 2010, pp. 1-89.

Superior Essex Inc.'s and Superior Essex Communications LP's Answering Brief in Opposition to Belden's Motion for Partial Summary Judgment of Patent Infringement, Redacted Public Version, from Delaware District Court C.A. No. 08-063-SLR, Jan. 20, 2010, pp. 1-32.

Superior Essex Inc.'s and Superior Essex Communications LP's Memorandum in Opposition to Belden's Proposed Claim Constructions, Redacted Public Version, from Delaware District Court C.A. No. 08-063-SLR, Jan. 20, 2010, pp. 1-48.

Plaintiffs Belden Technologies, Inc. and Belden CDT (Canada), Inc.'s Answering Brief in Opposition to Superior Essex Inc. and Superior Essex Communications LP's Motion for Partial Summary Judgment of Non-Infringement, Redacted Public Version, from Delaware District Court C.A. No. 08-063-SR, Jan. 20, 2010, pp. 1-25.

Answering Brief of Plaintiffs Belden Technologies, Inc. and Belden CDT (Canada) Inc. in Opposition to Superior Essex Inc. and Superior Essex Communications LP's Motion for Summary Judgment of Invalidity of the Patents-in-Suit, Redacted Public Version, from Delaware District Court C.A. No. 08-063-SLR, Jan. 20, 2010, pp. 1-48.

Reply Claim Construction Brief of Plaintiffs Belden Technologies, Inc. and Belden CDT (Canada) Inc., Redacted Public Version, from Delaware District Court C.A. No. 08-063-SLR, Feb. 17, 2010, pp.. 1-28.

Reply Brief of Plaintiffs Belden Technologies, Inc. and Belden CDT (Canada), Inc. In Support of their Motion for Partial Summary Judgment No. 2 No. Patent Invalidity by Anticipation, Redacted Public Version, from Delaware District Court C.A. No. 08-063-SLR, Feb. 17, 2010, pp. 1-26.

Superior Essex Inc.'s and Superior Essex Communications LP's Reply Brief in Support of Defendants' Proposed Claim Constructions, Redacted Public Version, from Delaware District Court C.A. No. 08-063-SLR, Feb. 17, 2010, pp. 1-29.

(56) References Cited

OTHER PUBLICATIONS

Opening Claim Construction Brief of Plaintiffs Belden Technologies, Inc. and Belden CDT (Canada), Inc. from Delaware District Court C.A. No. 08-063-SLR, Dec. 4, 2009, pp. 1-49.
Plaintiffs Belden Technologies, Inc.'s and Belden CDT (Canada), Inc.'s Memorandum in Support of their Motion for Partial Summary Judgment No. 1: Patent Infringement, Redacted Public Version, from Delaware District Court C.A. No. 08-063-SLR, Dec. 4, 2009, pp. 1-43.
Declaration of Michelle A. Flores in Support of Plaintiffs Belden Technologies, Inc.'s and Belden CDT (Canada) Inc.'s Motion for Partial Summary Judgment No. 1: Patent Infringement, Redacted Public Version, from Delaware District Court C.A. No. 08-063-SLR, Dec. 11, 2009, pp. 1-17.
Plaintiffs Belden Technologies, Inc.'s and Belden CDT (Canada), Inc.'s Memorandum in Support of their Motion for Partial Summary Judgment No. 2: No Patent Invalidity by Anticipation, Redacted Public Version, from Delaware District Court C.A. No. 08-063-SLR, Dec. 4, 2009, pp. 1-50.
Declaration of Michelle A. Flores in Support of Plaintiffs Belden Technologies, Inc.'s and Belden CDT (Canada) Inc.'s Motion for Partial Summary Judgment No. 2: No Patent Invalidity by Anticipation, Redacted Public Version, from Delaware District Court C.A. No. 08-063-SLR, Dec. 11, 2009, pp. 1-5.
Defendant's Opening Claim Construction Brief, Redacted Public Version, from Delaware District Court C.A. No. 08-063-SLR, Dec. 4, 2009, pp. 1-47.
Superior Essex Inc.'s and Superior Essex Communications LP's Opening Brief in Support of Their Motion for Partial Summary Judgment of Non-Infringement, Redacted Public Version, from Delaware District Court C.A. No. 08-063-SLR, Dec. 4, 2009, pp. 1-25.
Superior Essex Inc.'s and Superior Essex Communications LP's Opening Brief in Support of Their Motion for Summary Judgment of Invalidity of the Patents-in-Suit, Redacted Public Version, from Delaware District Court C.A. No. 08-063-SLR, Dec. 4, 2009, pp. 1-47.
Second Supplemental Joint Appendix to Claim Construction Briefing, Redacted Public Version, from Delaware District Court C.A. No. 08-063-SLR, Feb. 17, 2010, pp. 1-26.
Letter to Bob Grow, Chair IEEE 802.3 from Bob Jensen, Chair TIA TR 42, Subject: TR 42 Liaison to IEEE 802.3, Oct. 10, 2003, 2 pages.
Excerpts from Belden Inc., Form 10-K, for the fiscal year ended Dec. 31, 2008.
Complaint filed with Jury Demand against Superior Essex Inc., Superior Essex Communications LP—Magistrate Consent Notice to Pltf. (Filing fee $350, receipt No. 150554.)—filed by Belden Technologies Inc., Belden CDT (Canada) Inc. (Attachments: # 1 Exhibit a # 2 Exhibit B# 3 Exhibit C #4 Exhibit D# 5 Exhibit E # 6 Exhibit F# 7 Civil Cover Sheet #8 Acknowledgement of Consent Form) (lid) (Entered: Jan. 29, 2008).
Answer to Complaint, with Jury Demand, Counterclaim against Belden Technologies Inc., Belden CDT (Canada) Inc. by Superior Essex Inc., Superior Essex Communications LP. (Gaza, Anne) (Entered: Jun. 6, 2008).
Answer to Answer to Complaint, Counterclaim to Belden Technologies Inc., Belden CDT (Canada) Inc. (Shaw, John) (Entered: Jun. 12, 2008).
First Amended Complaint and Jury Demand against Superior Essex Inc., Superior Essex Communications LP-filed by Belden Technologies Inc., Belden CDT (Canada) Inc. (Attachments: #1 Exhibit A-G) (Keller, Karen) (Entered: Feb. 25, 2009).
Answer to Amended Complaint with Pursuant to Rule 38(b) of the Federal Rules of Civil Procedure Defendants demand a trial by jury of all issues so triable in this action. Affirmative Defenses, Counterclaim against Belden Technologies Inc. (Canada) Inc. by Superior Essex Inc., Superior Essex Communications LP (Gaza, Anne) (Entered: Mar. 16, 2009).
Second Amended Complaint against Superior Essex Inc., Superior Essex Communications LP—Filed by Belden Technologies Inc., Belden CDT (Canada) Inc. (Attachments: #1 Exhibit A-H) (Poff, Adam) (Entered: Apr. 6, 2009).
Answer to Amended Complaint with Jury Demand, Counterclaim against Belden Technologies Inc., Belden CDT (Canada) Inc. by Superior Essex Inc., Superior Essex Communications LP (Brewington, Lori) (Entered: Apr. 23, 2009).
Claim Construction Chart by Belden CDT (Canada) Inc., Belden Technologies Inc., Superior Essex Communications LP, Superior Essex Inc. (Kraman, Pilar) (Entered: Nov. 16, 2009).
Joint Appendix re Claim Construction Brief—to all Claim Construction Briefing (vol. 1 of 3) by Belden CDT (Canada) Inc., Belden Technologies Inc., (Attachments: #1 Exhibit 1, #2 Exhibit 2, # 3 Exhibit 3, #4 Exhibit 4A, # 5 Exhibit 4B, # 6 Exhibit 5, # 7 Exhibit 6A, # 8 Exhibit 6B, # 9 Exhibit 6C, # 10 Exhibit 7, # 11 Exhibit 8A, # 12 Exhibit 8B, # 13 Exhibit 9, # 14 Exhibit 10A) (Kraman, Pilar) (Entered: Dec. 4, 2009).
Joint Appendix re Appendix, Claim Construction Opening Brief to All Claim Construction Briefing (vol. 2 of 3) by Belden CDT (Canada) Inc., Belden Technologies Inc., (Attachments: #1 Exhibit 10B, #2 Exhibit 11, # 3 Exhibit 12A, #4 Exhibit 12B, # 5 Exhibit 12C, # 6 Exhibit 12D, # 7 Exhibit 12E, # 8 Exhibit 12F, # 9 Exhibit 13, # 10 Exhibit 14A, # 11 Exhibit 14B, # 12 Exhibit 14C, (Kraman, Pilar) (Entered: Dec. 4, 2009).
C&M Corporation Engineering Design Guide, 3rd Edition, 1992, p. 11.
Declaration of Anne Shea Gaza, Redacted Public Version, from Delaware District Court C.A. No. 08-063-SLR, Dec. 11, 2009, pp. 1-16.
Joint Appendix re Appendix, Appendix, Claim Construction Opening Brief to All Claim Construction Briefing (vol. 3 of 3) by Belden CDT (Canada) Inc., Belden Technologies Inc., (Attachments: (Attachments: #1 Exhibit 14D, #2 Exhibit 15, # 3 Exhibit 16A, #4 Exhibit 16B, # 5 Exhibit 16C, # 6 Exhibit 16D, # 7 Exhibit 16E, # 8 Exhibit 16F, # 9 Exhibit 16G, # 10 Exhibit 17, # 11 Exhibit 18, # 12 Exhibit 19, # 13 Exhibit 20, # 14 Exhibit 21, # 15 Exhibit 22, #16 Exhibit 23, # 17 Exhibit 24 through 29, (Kraman, Pilar) (Entered: Dec. 4, 2009).

* cited by examiner

ENHANCED DATA CABLE WITH CROSS-TWIST CABLED CORE PROFILE

This application is a continuation of application Ser. No. 09/532,837, filed Mar. 21, 2000 entitled Enhanced Data Cable with Cross-Twist Cabled Core Profile and now U.S. Pat. No. 6,596,944, which is a continuation of application Ser. No. 08/841,440, filed Apr. 22, 1997 entitled Making Enhanced Data Cable with Cross-Twist Cabled Core Profile (as amended), and now U.S. Pat. No. 6,074,503.

BACKGROUND

1. Field of the Invention

The present invention relates to high-speed data communications cables using at least two twisted pairs of wires. More particularly, it relates to cables having a central core defining plural individual pair channels.

2. Related Art

High-speed data communications media in current usage include pairs of wire twisted together to form a balanced transmission line. Such pairs of wire are referred to as twisted pairs. One common type of conventional cable for high-speed data communications includes multiple twisted pairs. When twisted pairs are closely placed, such as in a cable, electrical energy may be transferred from one pair of a cable to another. Such energy transferred between pairs is undesirable and referred to as crosstalk. The Telecommunications Industry Association and Electronics Industry Association have defined standards for crosstalk, including TIA/EIA-568A. The International Electrotechnical Commission has also defined standards for data communication cable crosstalk, including ISO/IEC 11801. One high-performance standard for 1000 cable is ISO/IEC 11801, Category 5.

In conventional cable, each twisted pair of a cable has a specified distance between twists along the longitudinal direction, that distance being referred to as the pair lay. When adjacent twisted pairs have the same pair lay and/or twist direction, they tend to lie within a cable more closely spaced than when they have different pair lays and/or twist direction. Such close spacing increases the amount of undesirable crosstalk which occurs. Therefore, in some conventional cables, each twisted pair within the cable has a unique pair lay in order to increase the spacing between pairs and thereby to reduce the crosstalk between twisted pairs of a cable. Twist direction may also be varied. Along with varying pair lays and twist directions, individual solid metal or woven metal pair shields are sometimes used to electromagnetically isolate pairs.

Shielded cable, although exhibiting better crosstalk isolation, is more difficult and time consuming to install and terminate. Shield conductors are generally terminated using special tools, devices and techniques adapted for the job.

One popular cable type meeting the above specifications is Unshielded Twisted Pair (UTP) cable. Because it does not include shield conductors, UTP is preferred by installers and plant managers, as it is easily installed and terminated. However, UTP fails to achieve superior crosstalk isolation, as required by state of the art transmission systems, even when varying pair lays are used.

Another solution to the problem of twisted pairs lying too closely together within a cable is embodied in a cable manufactured by Belden Wire & Cable Company as product number 1711A. This cable includes four twisted pair media radially disposed about a "+"-shaped core. Each twisted pair nests between two fins of the "+"-shaped core, being separated from adjacent twisted pairs by the core. This helps reduce and stabilize crosstalk between the twisted pair media. However, the core adds substantial cost to the cable, as well as material which forms a potential fire hazard, as explained below, while achieving a crosstalk reduction of only about 5 dB.

In building design, many precautions are taken to resist the spread of flame and the generation of and spread of smoke throughout a building in case of an outbreak of fire. Clearly, it is desired to protect against loss of life and also to minimize the costs of a fire due to the destruction of electrical and other equipment. Therefore, wires and cables for in building installations are required to comply with the various flammability requirements of the National Electrical Code (NEC) and/or the Canadian Electrical Code (CEC).

Cables intended for installation in the air handling spaces (ie. plenums, ducts, etc.) of buildings are specifically required by NEC or CEC to pass the flame test specified by Underwriters Laboratories Inc. (UL), UL-910, or it's Canadian Standards Association (CSA) equivalent, the FT6. The UL-910 and the FT6 represent the top of the fire rating hierarchy established by the NEC and CEC respectively. Cables possessing this rating, generically known as "plenum" or "plenum rated", may be substituted for cables having a lower rating (ie. CMR, CM, CMX, FT4, FT1 or their equivalents), while lower rated cables may not be used where plenum rated cable is required.

Cables conforming to NEC or CEC requirements are characterized as possessing superior resistance to ignitability, greater resistant to contribute to flame spread and generate lower levels of smoke during fires than cables having a lower fire rating. Conventional designs of data grade telecommunications cables for installation in plenum chambers have a low smoke generating jacket material, e.g. of a PVC formulation or a fluoropolymer material, surrounding a core of twisted conductor pairs, each conductor individually insulated with a fluorinated ethylene propylene (FEP) insulation layer. Cable produced as described above satisfies recognized plenum test requirements such as the "peak smoke" and "average smoke" requirements of the Underwriters Laboratories, Inc., UL910 Steiner test and/or Canadian Standards Association CSA-FT6 (Plenum Flame Test) while also achieving desired electrical performance in accordance with EIA/TIA-568A for high frequency signal transmission.

While the above-described conventional cable including the Belden 1711A cable due in part to their use of FEP meets all of the above design criteria, the use of fluorinated ethylene propylene is extremely expensive and may account for up to 60% of the cost of a cable designed for plenum usage.

The solid core of the Belden 1711A cable contributes a large volume of fuel to a cable fire. Forming the core of a fire resistant material, such as FEP, is very costly due to the volume of material used in the core.

Solid flame retardant/smoke suppressed polyolefin may also be used in connection with FEP. Solid flame retardant/smoke suppressed polyolefin compounds commercially available all possess dielectric properties inferior to that of FEP. In addition, they also exhibit inferior resistance to burning and generally produce more smoke than FEP under burning conditions than FEP.

SUMMARY OF THE INVENTION

This invention provides an improved data cable.

According to one embodiment, the cable includes a plurality of transmission media; a core having a surface defining recesses within which each of the plurality of transmission media are individually disposed; and an outer jacket maintaining the plurality of data transmission media in position with respect to the core.

According to another embodiment of the invention, a cable includes a plurality of transmission media radially disposed about a core having a surface with features which maintain a separation between each of the plurality of transmission media.

Finally, according to yet another embodiment of the invention, there is a method of producing a cable. The method first passes a plurality of transmission media and a core through a first die which aligns the plurality of transmission media with surface features of the core and prevents twisting motion of the core. Next, the method bunches the aligned plurality of transmission media and core using a second die which forces each of the plurality of transmission media into contact with the surface features of the core which maintain a spatial relationship between each of the plurality of transmission media. Finally, the bunched plurality of transmission media and core are twisted to close the cable, and the closed cable is jacketed.

BRIEF DESCRIPTION OF THE DRAWINGS

In the drawings, in which like reference numerals designate like elements.

DETAILED DESCRIPTION

An embodiment of the invention is now described in which a cable is constructed to include four twisted pairs of wire and a core having a unique profile. However, the invention is not limited to the number of pairs or the profile used in this embodiment. The inventive principles can be applied to cables including greater or fewer numbers of twisted pairs and different core profiles. Also, although this embodiment of the invention is described and illustrated in connection with twisted pair data communication media, other high-speed data communication media can be used in constructions of cable according to the invention.

Figure 1:
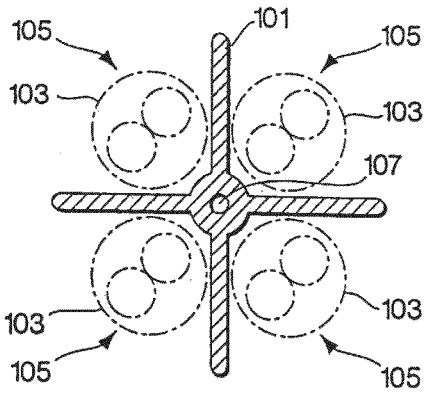
FIG. 1 is a cross-sectional view of a cable core used in embodiments of the invention.

This illustrative embodiment of the invention, as shown in FIG. 1, includes an extruded core 101 having a profile described below cabled into the cable with four twisted pairs 103. The extruded core profile has an initial shape of a "+", providing four spaces or channels 105 between each pair of fins of the core. Each channel 105 carries one twisted pair 103 placed within the channel 105 during the cabling operation. The illustrated core 101 and profile should not be considered limiting. The core 101 may be made by some other process than extrusion and may have a different initial shape or number of channels 105. For example, there may be an optional central channel 107 provided to carry a fiber optic element.

The above-described embodiment can be constructed using a number of different materials. While the invention is not limited to the materials now given, the invention is advantageously practiced using these materials. The core material should be a conductive material or one containing a powdered ferrite, the core material being generally compatible with use in data communications cable applications, including any applicable fire safety standards. In non-plenum applications, the core can be formed of solid or foamed flame retardant polyolefin or similar materials. In plenum applications, the core can be any one or more of the following compounds: a solid low dielectric constant fluoropolymer, e.g., ethylene chlortrifluoroethylene (E-CTFE) or fluorinated ethylene propylene (FEP), a foamed fluoropolymer, e.g., foamed FEP, and polyvinyl chloride (PVC) in either solid, low dielectric constant form or foamed. A filler is added to the compound to render the extruded product conductive. Suitable fillers are those compatible with the compound into which they are mixed, including but not limited to powdered ferrite, semiconductive thermoplastic elastomers and carbon black. Conductivity of the core helps to further isolate the twisted pairs from each other.

A conventional four-pair cable including a non-conductive core, such as the Belden 1711A cable, reduces nominal crosstalk by up to 5 dB over similar, four-pair cable without the core. By making the core conductive, crosstalk is reduced a further 5 dB. Since both loading and jacket construction can affect crosstalk, these figures compare cables with similar loading and jacket construction.

Figure 2:
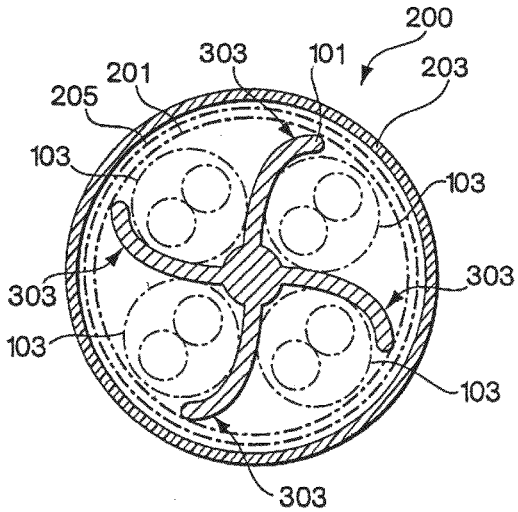
FIG. 2 is a cross-sectional view of one embodiment of a cable including the core of FIG. 1.

The cable may be finished in any one of several conventional ways, as shown in FIG. 2. The combined core 101 and twisted pairs 103 may be optionally wrapped with a dielectric tape 201, then jacketed 205 to form cable 200. An overall conductive shield 205 can optionally be applied over the cable before jacketing to prevent the cable from causing or receiving electromagnetic interference. The jacket 203 may be PVC or another material as discussed above in relation to the core 101. The dielectric tape 201 may be polyester, or another compound generally compatible with data communications cable applications, including any applicable fire safety standards.

Figure 3:
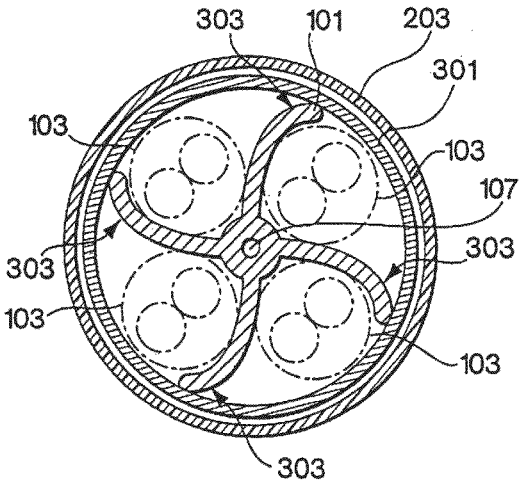
FIG. 3 is a cross-sectional view of another embodiment of a cable including the core of FIG. 1.
Figure 4:
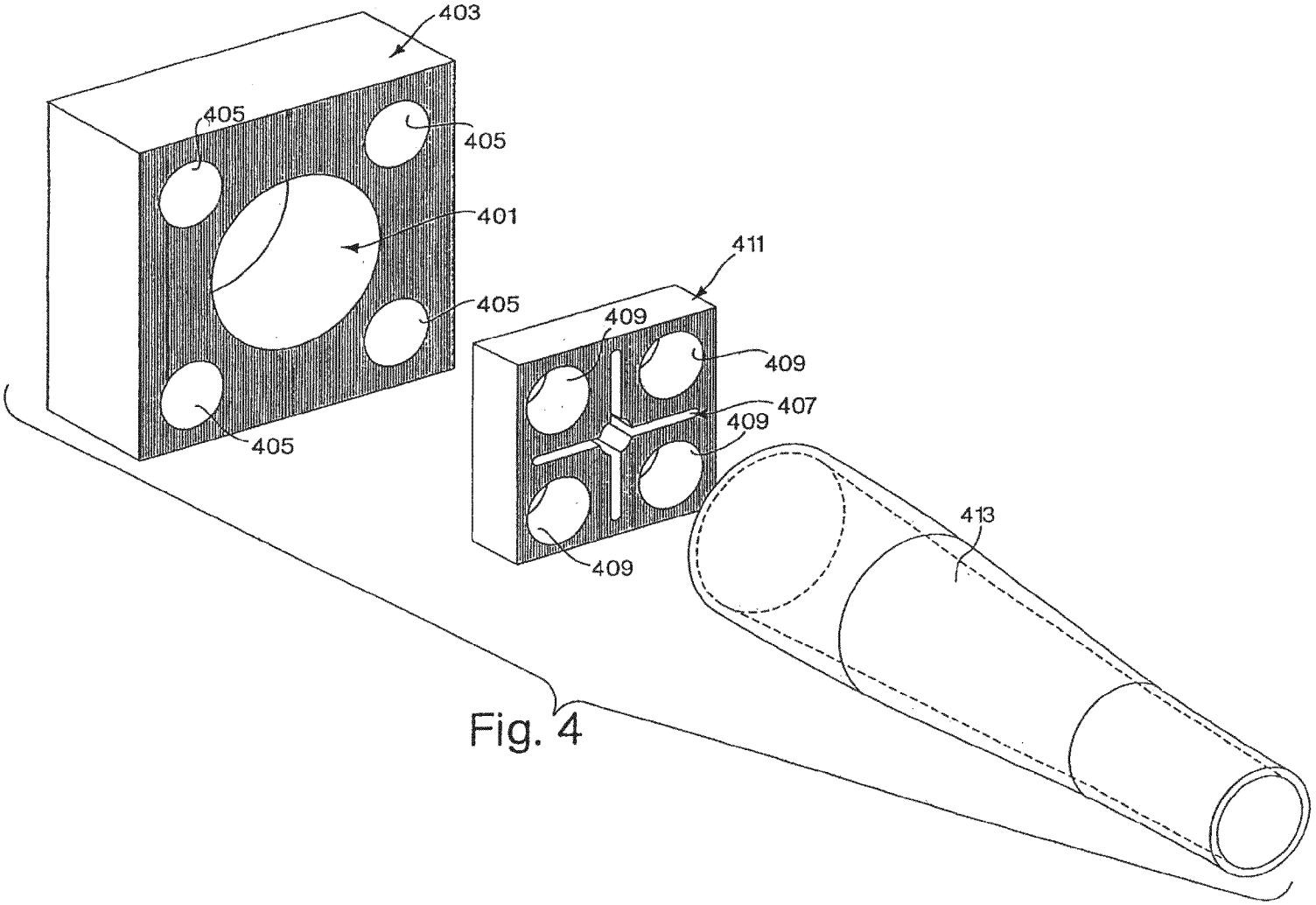
FIG. 4 is a perspective view of a die system for practicing a method of making a cable in accordance with another embodiment of the invention.
Figure 5:
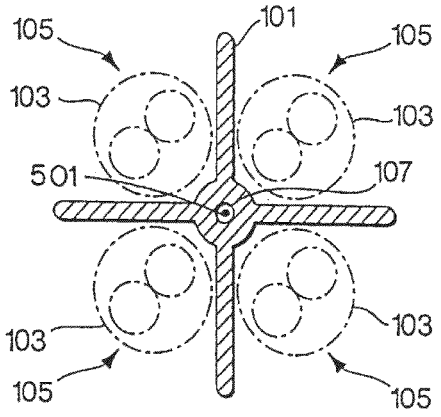
FIG. 5 is a cross-sectional view of an embodiment of a cable.
Figure 6:
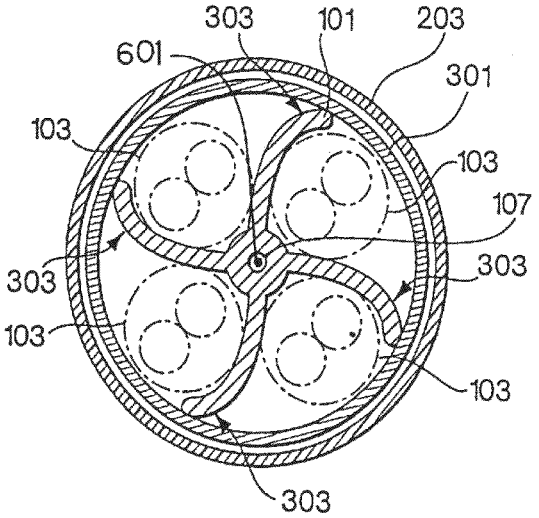
FIG. 6 is a cross-sectional view of an embodiment of a cable.

Greater crosstalk isolation is achieved in the construction of FIG. 3, by using a conductive shield 301, for example a metal braid, a solid metal foil shield or a conductive plastic layer in contact with the ends of the fins 303 of the core 101. Such a construction rivals individual shielding of twisted pairs for crosstalk isolation. This construction optionally can advantageously include a drain wire in a central channel 107. In the constructions of both FIGS. 2 and 3 it is advantageous to have the fins 303 of the core 101 extend somewhat beyond a boundary defined by the outer dimension of the twisted pairs 103. In the construction of FIG. 2 this ensures that he twisted pairs 103 do not escape their respective channels 105 prior to the cable being jacketed, while in that of FIG. 3 and good contact between the fins 303 and the shield 301 is ensured. In both constructions, closing and jacketing the cable may bend the tips of the fins 303 over slightly, as shown in the core material is relatively soft, such as PVC.

A method of making cable in accordance with the above-described embodiments is now described.

As is known in this art, when plural elements are cabled together, an overall twist is imparted to the assembly to improve geometric stability and help prevent separation. In embodiments of the present invention, twisting of the profile of the core along with the individual twisted pairs is controlled. The process allows the extruded core to maintain a physical spacing between the twisted pairs and maintains geometrical stability within the cable. Thus, the process assists in the achievement of and maintenance of high crosstalk isolation by placing a conductive core in the cable to maintain pair spacing.

Cables of the previously described embodiments, can be made by a three-part die system. However, methods of making such cables are not limited to a three-part die system, as more or fewer die elements can be constructed to incorporate the features of the invention.

The extruded core is drawn from a payoff reel (not shown) through the central opening 401 in die 403. Four twisted pairs are initially aligned with the core by passing through openings 405 in die 403. The core is next brought through opening 407 and brought together with the four twisted pairs which are passed through openings 409 in a second die 411, then cabled with the twisted pairs which are pushed into the channels of the core by a third die 413, in an operation called bunching. The second die 411 eliminates back twist, which is inherent in bunching operations, thus allowing the third die 413 to place the pairs in the channels prior to the twisting. The cable twist is imparted to the cable assembly after the second die 411, which locates the twisted pairs relative to the extruded core profile.

Although the method of making cable has been described in connection with an extruded core delivered into the process from a payoff reel, the invention is not so limited. For example, the core could be extruded immediately prior to use and transferred directly from the extruder to the central opening 401 of the first die 403. In another variation, the core could be extruded directly through a properly shaped central opening of either the first die 403 or the second die 411.

The present invention has now been described in connection with a number of specific embodiments thereof. However, numerous modifications which are contemplated as falling within the scope of the present invention should now be apparent to those skilled in the art. Therefore, it is intended that the scope of the present invention be limited only by the scope of the claims appended hereto.

What is claimed is:

1. An unshielded high speed data communications cable comprising:

a plurality of twisted pairs of conductors;

a non-conductive central core including a plurality of fins having substantially parallel sides extending radially outward from a central region of the non-conductive central core, wherein at least one fin of the plurality of fins extends to at least an outer boundary defined by an outer dimension of at least one of the twisted pairs of conductors, the plurality of fins defining a corresponding plurality of channels within which the plurality of twisted pairs of conductors are individually disposed, the non-conductive central core being formed of a low dielectric constant polyolefin; and an outer jacket being formed of a non-conductive material, the outer jacket maintaining the plurality of twisted pairs within the plurality of channels.

2. The unshielded high speed data communications cable of claim 1, wherein said at least one fin is bent at a tip by the outer jacket.

3. The unshielded high speed data communications cable of claim 1, further comprising a binder wrapped around the plurality of twisted pairs and non-conductive central core, the binder together with the outer jacket maintaining the plurality of twisted pairs of conductors within the plurality of channels.

4. The unshielded high speed data communications cable of claim 3, wherein said at least one fin is bent at a tip by the outer jacket and/or the binder.

5. The unshielded high speed data communications cable of claim 3, wherein the binder comprises a dielectric tape.

6. The unshielded high speed data communications cable of claim 5, wherein the dielectric tape is a polyester tape.

7. The unshielded high speed data communications cable of claim 1, wherein the plurality of fins consists of four fins and the plurality of channels consists of four channels that are defined by adjacent pairs of the four fins.

8. The unshielded high speed data communications cable of claim 7, wherein each of the four fins extends radially outward from the central region of the non-conductive core at substantially right angles to at least one other of the four fins.

9. The unshielded high speed data communications cable of claim 1, wherein the plurality of fins position the plurality of twisted pairs in a substantially 90° relationship.

10. The unshielded high speed data communications cable of claim 1, wherein each fin of the plurality of fins has a rounded tip.

11. The unshielded high speed data communications cable of claim 1, wherein the cable is configured to be Underwriters Laboratories (UL) compliant, and wherein the non-conductive central core comprises at least one of a solid fluoropolymer, and a foamed fluoropolymer.

12. The unshielded high speed data communications cable of claim 11, wherein the outer jacket is formed of polyvinyl chloride.

13. The unshielded high speed data communications cable of claim 1, wherein the non-conductive central core is formed of a solid or foamed flame retardant polyolefin.

14. The unshielded high speed data communications cable of claim 1, wherein the non-conductive central core comprises a central cavity.

15. The unshielded high speed data communications cable of claim 14, further comprising a fiber optic element disposed within the central cavity.

16. The unshielded high speed data communications cable of claim 1, wherein each twisted pair of conductors comprises a metal conductor insulated with fluoroethylene-propylene (FEP).

17. The unshielded high speed data communications cable of claim 1, wherein the at least one fin of the plurality of fins extends beyond the outer boundary defined by the outer dimension of at least one of the twisted pairs of conductors to contact the outer jacket.

18. The unshielded high speed data communications cable of claim 17, wherein the at least one fin of the plurality of fins is bent at a tip by the outer jacket.

19. The unshielded high speed data communications cable of claim 1, wherein the plurality of fins comprises four fins, further comprising:

each of the four fins configured to extend beyond the outer boundary defined by the outer dimension of at least one of the twisted pairs of conductors to contact the outer jacket.

20. The unshielded high speed data communications cable of claim 19, wherein the at each of the four fins is bent at a tip by the outer jacket.

21. The unshielded high speed data communications cable of claim 1, wherein the non-conductive central core is twisted.

22. The unshielded high speed data communications cable of claim 1, wherein the plurality of fins are twisted.

23. The unshielded high speed data communications cable of claim 1, wherein the plurality of twisted pairs of conductors are twisted.

24. The unshielded high speed data communications cable of claim 1, wherein the plurality of twisted pairs, the nonconductive central core, and the plurality of fins are twisted along a longitudinal axis of the unshielded high speed data communications cable to form a closed cable.

25. The unshielded high speed data communications cable of claim 1, further comprising:

transmission media that includes at least one of the plurality of twisted pairs, the non-conductive central core, and the plurality of fins, wherein at least a portion of the transmission media are twisted along a longitudinal axis of the unshielded high speed data communications cable.

26. An unshielded high speed data communications cable comprising:

a plurality of twisted pairs of conductors;

a non-conductive central core including a plurality of fins extending radially outward from a center of the core, at least one fin extending to at least an outer boundary defined by an outer dimension of the twisted pairs of conductors, the plurality of fins defining a plurality of channels within which the plurality of twisted pairs of conductors are individually disposed, the non-conductive central core being formed of a low dielectric constant flame retardant polyolefin;

an outer jacket covering the plurality of twisted pairs of conductors and the non-conductive central core and arranged to maintain the plurality of twisted pairs of conductors in position with respect to the non-conductive central core, the outer jacket being formed of a nonconductive material;

wherein the at least one fin of the non-conductive central core is bent at a tip by the outer jacket; and wherein the unshielded data cable does not include a shield that encloses any of the plurality of twisted pairs of conductors and the non-conductive central core.

27. The unshielded high speed data communications cable of claim 26, wherein the plurality of fins consists of four fins, each fin extending radially outward from the center of the core at substantially right angles to at least one other of the four fins.

28. The unshielded high speed data communications cable of claim 26, wherein the outer jacket consists of single layer of the non-conductive material.

* * * * *